US011597415B2

(12) United States Patent
Boronkai et al.

(10) Patent No.: US 11,597,415 B2
(45) Date of Patent: Mar. 7, 2023

(54) BALLISTIC PROTECTION ARRANGEMENT FOR VEHICLES

(71) Applicant: SIEMENS MOBILITY AUSTRIA GmbH

(72) Inventors: Laszlo Boronkai, Gratkorn (AT); Caroline Cassignol, Munich (DE)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 685 days.

(21) Appl. No.: 16/493,927

(22) PCT Filed: Mar. 12, 2018

(86) PCT No.: PCT/EP2018/056025

§ 371 (c)(1),
(2) Date: Sep. 13, 2019

(87) PCT Pub. No.: WO2018/166949

PCT Pub. Date: Sep. 20, 2018

(65) Prior Publication Data

US 2021/0122400 A1 Apr. 29, 2021

(30) Foreign Application Priority Data

Mar. 14, 2017 (AT) ..... 50203/2017

(51) Int. Cl.

| | |
|---|---|
| ***B61F 5/52*** | (2006.01) |
| ***F41H 7/04*** | (2006.01) |
| *B61F 15/26* | (2006.01) |

(52) U.S. Cl.

CPC ..... *B61F 5/523* (2013.01); *F41H 7/04* (2013.01); *B61F 15/26* (2013.01)

(58) Field of Classification Search

CPC ..... B61F 19/02; B61F 5/523; B61F 15/56; F41F 7/04; B60B 17/0034; B60B 37/06

(Continued)

(56) References Cited

U.S. PATENT DOCUMENTS 2,747,918 A * 5/1956 Blackwood ..... B60B 37/08 403/228
2,984,486 A * 5/1961 Jones ..... A63B 60/08 473/568

(Continued)

FOREIGN PATENT DOCUMENTS

DE 19825402 2/2000
DE 102010009437 8/2011

(Continued)

OTHER PUBLICATIONS

PCT International Search Report dated Jun. 5, 2018 based on PCT/EP2018/056025 filed Mar. 12, 2018.

*Primary Examiner* — Joshua E Freeman
(74) *Attorney, Agent, or Firm* — Cozen O'Connor

(57) ABSTRACT

A ballistic protection arrangement for vehicles, in particular for rail vehicles chassis, with at least one first wheelset which has a first wheel, a second wheel and a wheelset shaft, wherein in order to provide advantageous construction conditions, a shell includes at least one first material layer, which includes a first fibre material, arranged around the wheelset shaft such that the wheelset shaft is advantageously protected from damage, for example, due to stone impacts at particularly high travelling speeds and at particularly low temperatures, where the first fibre material of the first material layer brings about high absorption of energy with the protection arrangement while, at the same time, having a low mass.

16 Claims, 4 Drawing Sheets

(58) Field of Classification Search
USPC ..... 105/218.1
See application file for complete search history.

(56) References Cited

U.S. PATENT DOCUMENTS

| | | | | | |
|---|---|---|---|---|---|
| 4,158,407 | A * | 6/1979 | Rest | B65D 59/00 | 295/36.1 |
| 4,352,316 | A * | 10/1982 | Medlin | F41H 7/044 | 442/244 |
| 4,867,444 | A * | 9/1989 | Castillo | A63B 21/0724 | 482/106 |
| 5,767,435 | A * | 6/1998 | Reymann | F41H 5/0457 | 89/36.02 |
| 6,511,380 | B1 * | 1/2003 | Oetiker | F16J 3/042 | 464/175 |
| 6,568,333 | B1 * | 5/2003 | Kontio | F16C 3/02 | 295/36.1 |
| 6,604,789 | B1 * | 8/2003 | Downing | A47C 31/11 | 5/663 |
| 7,232,352 | B2 * | 6/2007 | Splaine | B63H 16/04 | 440/101 |
| 8,071,206 | B1 * | 12/2011 | Chang | F42D 5/045 | 428/316.6 |
| 9,238,472 | B2 * | 1/2016 | Meyer | B60B 17/0034 | |
| 9,315,072 | B2 * | 4/2016 | Lübben | B61F 5/50 | |
| 10,414,921 | B1 * | 9/2019 | Dehni | C08G 18/7664 | |
| 10,836,409 | B2 * | 11/2020 | Cervello | B61F 19/02 | |
| 2007/0044646 | A1 * | 3/2007 | Smiley | F41H 7/04 | 89/36.17 |
| 2012/0319420 | A1 * | 12/2012 | Meyer | B60B 17/0034 | 295/36.1 |
| 2014/0274614 | A1 * | 9/2014 | Newman | A63B 21/4035 | 482/139 |
| 2015/0059042 | A1 * | 3/2015 | Aquino | A41B 1/08 | 2/2.5 |
| 2016/0202023 | A1 * | 7/2016 | Osman | A41F 15/002 | 2/2.5 |
| 2018/0022060 | A1 * | 1/2018 | Downs | B32B 27/34 | 89/36.02 |
| 2019/0001211 | A1 * | 1/2019 | Burns | A63B 21/0724 | |

FOREIGN PATENT DOCUMENTS

| | | | | |
|---|---|---|---|---|
| DE | 102012205220 | | 10/2013 | |
| DE | 202014008476 | | 11/2014 | |
| DE | 102013212436 | | 12/2014 | |
| EP | 1942040 | | 7/2008 | |
| EP | 2345491 | | 7/2011 | |
| FR | 2911102 | * | 7/2008 | B61F 5/50 |
| WO | WO00/59764 | | 10/2000 | |
| WO | WO/2018025198 | | 2/2018 | |

* cited by examiner

BALLISTIC PROTECTION ARRANGEMENT FOR VEHICLES

CROSS-REFERENCE TO RELATED APPLICATIONS

This is a U.S. national stage of application No. PCT/EP2018/056025 filed Mar. 12, 2018. Priority is claimed on Application No. A50203/2017 filed Mar. 14, 2017, the content of which is incorporated herein by reference in its entirety.

BACKGROUND OF THE INVENTION

1. Field of the Invention

The invention relates to a ballistic protection arrangement for vehicles, in particular for chassis of rail vehicles having at least one wheelset which comprises a first wheel, a second wheel and a wheelset shaft.

2. Description of the Related Art

Components of vehicles, for example, wheelset shafts of wheelsets for rail vehicles, must be protected against damage. Wheelset shafts must be designed to withstand fatigue and high loading levels, in particular bending and torsion.

The design methods prescribed in the European standards (EN), in particular in EN 13104 and EN 13103 and in the Russian standards, in particular the design methods prescribed in OCT 32.93-97, apply only for non-corroded materials and undamaged surfaces. For this reason, wheelset shafts must have a corrosion protection and this and the wheelset shafts themselves must be protected against surface damage that can be caused, for example, by stone impacts, sand, snow and ice and the effect of high or low temperatures.

If surface damage (e.g. notches) occurs, affected wheelset shafts must be repaired, so that a large maintenance effort and high maintenance costs together with a low availability of the vehicles are caused.

From the prior art, for example, the Siemens Steel Rubber Axle Protection (SISRAP) wheelset shaft protection arrangement is known. SISRAP protects a wheelset shaft of a rail vehicle, for example, against stone impacts and comprises a low-temperature-resistant elastomer mat, half shells made of non-corroding steel sheet and fastening bands made of a non-corroding material.

The elastomer mat has a thickness of 3 mm and surrounds the wheelset shaft on which a corrosion-proof coating is provided. The elastomer mat is itself surrounded by two half-cylindrical half shells with thicknesses of 2 mm each. Cross-sections of the two half shells have the same radii.

DE 10 2010 009 437 A1 discloses the SISRAP wheelset shaft protection arrangement. In its known form, this approach has the disadvantages of a large mass of the wheelset protection arrangement and a low level of suitability for traveling speeds of the rail vehicle of greater than 250 km/h. For traveling speeds of over 250 km/h, the half shells must be configured with a large thickness.

Furthermore, the fastening bands must be configured, in particular for speeds of over 250 km/h, in large numbers or particularly thick, such that the mass and inertia of the wheelset shaft and the drive power levels required for the rail vehicle are increased. Furthermore, an increased space requirement in the region of the wheelset shaft and an increased effort for an assembly and disassembly of the wheelset shaft protection arrangement results therefrom.

Furthermore, WO 00/59764 discloses a wheelset shaft protection that is configured as a cylindrical tube. The tube comprises a slit that extends over a lateral surface of the tube and facilitates assembly and disassembly.

The tube can comprise two layers made of different plastics materials. Furthermore, the tube can be configured as multiple parts. Different closure devices are disclosed, whereby for example, two half shells are connected to one another by screw fastenings or the tube has a hook closure.

SUMMARY OF THE INVENTION

It is an object of the invention to provide a further developed ballistic protection arrangement as compared with the prior art.

This and other objects and advantages are achieved in accordance with the invention by a ballistic protection arrangement of the aforementioned type, where a shell that comprises at least a first material layer having a first fiber material is configured to be arranged round the wheelset shaft.

The use of a first fiber material that can comprise, for example, polyethylene fibers brings about a large energy absorption or damping for objects (e.g., basalt stones with a mass of up to 250 g) that impact on the wheelset shaft at a traveling speed of greater than 250 km/h. The wheelset is protected against deformations and other damage and an acoustic damping is achieved.

Furthermore, the ballistic protection arrangement can be configured with a low thickness and lightweight due to the first fiber material, so that a low mass and a low inertia of the wheelset shaft are achieved.

It is favorable if the shell has a second material layer. Here, the second material layer can be made, for example, of steel, titanium or a fiber-reinforced plastic and pressed together with the first material layer. The fiber-reinforced plastic can comprise a second fiber material with glass fibers and a matrix of organic material.

On the basis of the second material layer, a high level of tensile strength of the ballistic protection arrangement and therefore an advantageous resistance to impacting objects (e.g., stones, etc.) is achieved.

A combination of the first material layer and the second material layer can be configured thin and with little mass.

In an advantageous embodiment, the first material layer is configured as a fiber-reinforced plastic with the first fiber material and a second fiber material. By this measure, a ballistic protection arrangement is achieved with only one material layer which, however, also has a high energy-absorbing capacity, a high tensile strength and a low thickness and mass. The first fiber material can comprise, for example, polyethylene fibers that are mixed with the second fiber material, for example, with glass fibers and a matrix of organic material. With this, properties of a high energy-absorbing capacity and a high tensile strength are combined.

A favorable solution is achieved if the shell comprises at least one zip fastener. An easy assembly and disassembly capability of the ballistic protection arrangement on the wheelset shaft is thereby achieved. No tools are required.

Furthermore, the zip fastener has a small space requirement and a low mass as compared with a hook closure or a screw connection. Furthermore, no additional closure retention devices (e.g., cotter keys) are required.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention will now be described in greater detail making reference to exemplary embodiments, in which.

DETAILED DESCRIPTION OF THE EXEMPLARY EMBODIMENTS

Figure 1:
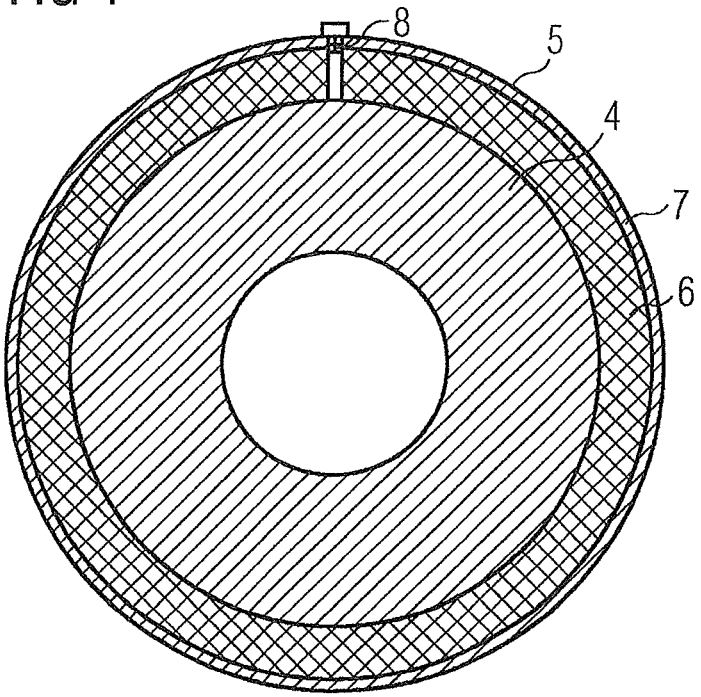
FIG. 1 is a side view of a wheelset shaft in a sectional representation with a first exemplary embodiment of an inventive ballistic protection arrangement which comprises a first material layer and a second material layer.

A side view of a wheelset shaft 4 of a rail vehicle shown in FIG. 1 in a sectional representation with a first exemplary embodiment of an inventive ballistic protection arrangement comprises a cylindrical shell 5 which has an inner first material layer 6 and an outer second material layer 7. The wheelset shaft 4 has a corrosion-proof coating (not shown).

The shell 5 surrounds the wheelset shaft 4 and is secured via a zip fastener 8. No movement, or only negligible movement, of the shell 5 relative to the wheelset shaft 4 is possible, i.e., the shell 5 is fixed on the wheelset shaft 4.

The first material layer 6 is compressed onto the second material layer 7, whereby for corresponding compression processes an autoclave (not shown) known from the prior art is used. The first material layer 6 comprises a first fiber material with a fiber fabric composed of artificial fibers that are made of polyethylene, via which a high energy-absorption capability is achieved.

The second material layer 7 is made of steel with a high tensile strength. Due to the first material layer 6 and the second material layer 7, properties of high energy-absorbing capability and high tensile strength are combined in an advantageous manner.

In accordance with the invention, it is also conceivable to make the second material layer 7 from titanium or fiber-reinforced plastic. In an embodiment in fiber-reinforced plastic, the fiber-reinforced plastic has a second fiber material made of glass fibers and a matrix of epoxy resin with flameproofing. However, in accordance with the invention, other organic matrix materials such as polyurethane are also conceivable.

The shell 5 has a thickness of 6 mm and is used for traveling speeds of the rail vehicle of up to 380 km/h.

Figure 2:
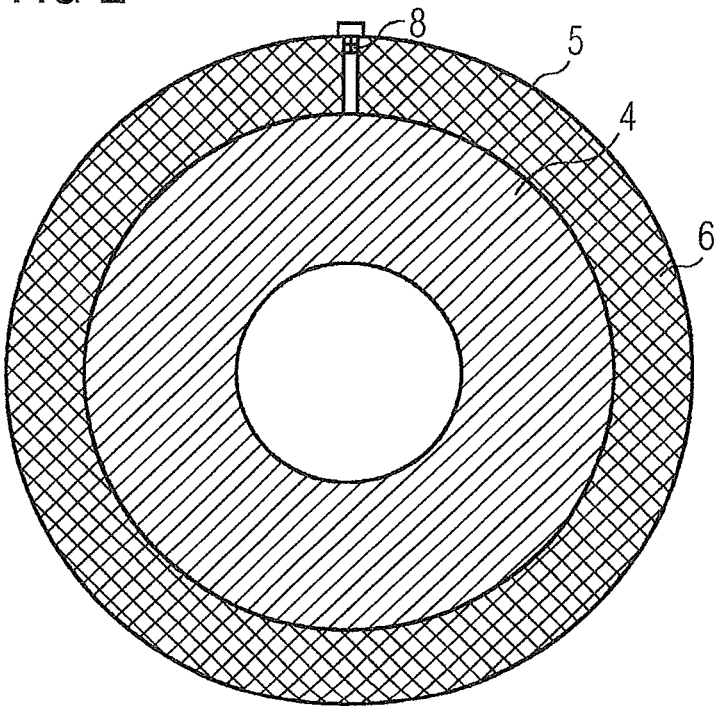
FIG. 2 is a side view of a wheelset shaft in a sectional representation with a second exemplary embodiment of an inventive ballistic protection arrangement which comprises just a first material layer.

FIG. 2 shows a side view of a wheelset shaft 4 of a rail vehicle in a sectional representation with a second exemplary embodiment of an inventive ballistic protection arrangement, where the ballistic protection arrangement comprises a cylindrical shell 5 with just a first material layer 6. The wheelset shaft 4 has a corrosion-proof coating (not shown).

The shell 5 encapsulates the wheelset shaft 4 and is secured via a zip fastener 8.

The first material layer 6 is made of fiber-reinforced plastic. The fiber-reinforced plastic has a first fiber material composed of polyethylene fibers and a second fiber material composed of glass fibers. A matrix material made of epoxy resin with flameproofing is provided. However, in accordance with the invention, other organic matrix materials such as polyurethane are also conceivable.

The first fiber material is mixed with the second fiber material, so that properties of a high energy-absorbing capability and a high tensile strength are combined in an advantageous manner.

Figure 3:
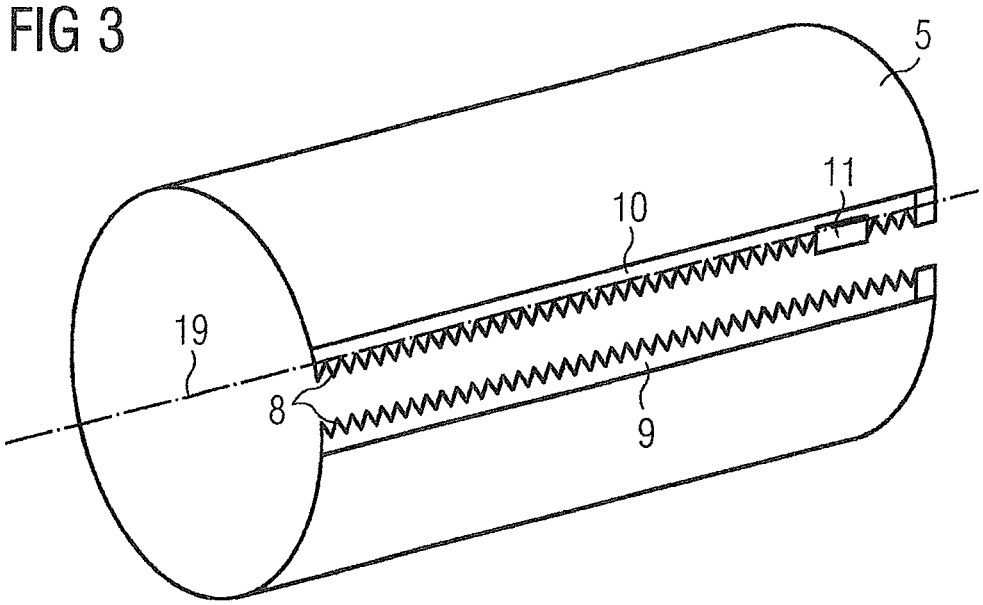
FIG. 3 is a perspective view of a shell of a third exemplary embodiment of an inventive ballistic protection arrangement which comprises a zip fastener.

FIG. 3 shows a perspective view of a shell 5 of a third exemplary embodiment of an inventive ballistic protection arrangement with a zip fastener 8. The zip fastener 8 is arranged on an outer surface of the cylindrical shell 5. The zip fastener 8 is configured straight and is oriented parallel to a wheelset longitudinal axis 19.

The zip fastener 8 is welded to the shell 5 that is made of a fiber-reinforced plastic. In accordance with the invention, it is also conceivable, for example, to interweave the zip fastener 8 with the shell 5.

Furthermore, it is also conceivable that the shell 5 comprises a first material layer 6 and a second material layer 7, where the second material layer 7 is made of a metallic material and the zip fastener 8 is welded to the second material layer 7.

The zip fastener 8 has a first tooth row 9 and a second tooth row 10 and a slider 11. With the slider 11, teeth of the first tooth row 9 and teeth of the second tooth row 10 can be hooked into one another and released again to close and open the shell 5. In a closed state of the zip fastener 8, the shell 5 is fixed on a wheelset shaft 4 (not shown in FIG. 3).

Figure 4:
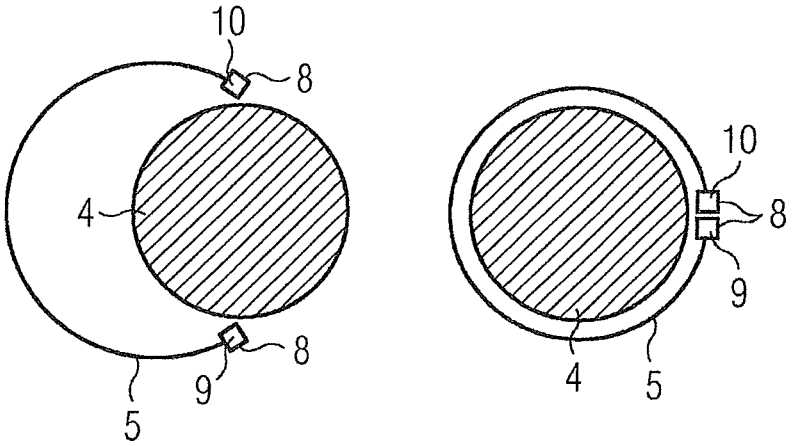
FIG. 4 is two side views of a wheelset shaft in a sectional representation with the third exemplary embodiment of an inventive ballistic protection arrangement.

FIG. 4 shows, at left, a first state of a shell 5 of a third exemplary embodiment of an inventive ballistic protection arrangement with a zip fastener 8 and, at right, a second state. The zip fastener 8 has a first tooth row 9 and a second tooth row 10.

In the first state, the zip fastener 8 is open and the shell 5 is bent open and partially pulled over a wheelset shaft 4.

In the second state, the shell 5 encapsulates the wheelset shaft 4 and the zip fastener 8 is closed, i.e. the first tooth row 9 and the second tooth row 10 are hooked into one another.

In the second state, the shell 5 is fixed on the wheelset shaft 4.

The shell 5 has a first material layer 6, as described, and as shown in FIG. 1, and a second material layer 7, where the first material layer 6 comprises a first fiber material with a fiber woven fabric. The second material layer 7 is configured as a thin steel sheet. The ballistic protection arrangement is therefore configured thin, lightweight and pliable, so that a small effort for assembly and disassembly, as shown in FIG. 4 at left, of the shell 5 is achieved.

Figure 5:
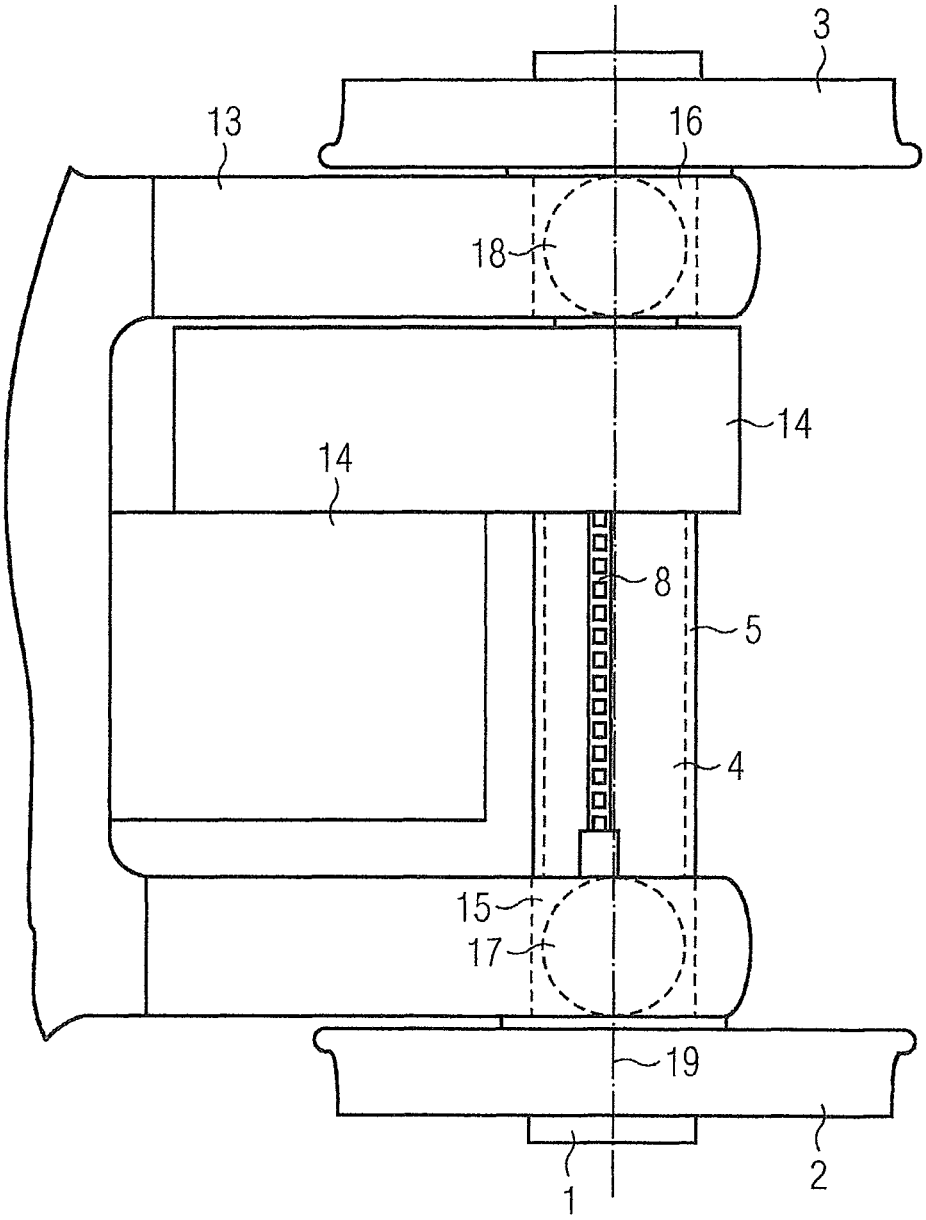
FIG. 5 is a plan view of a portion of a chassis with a first wheelset around the wheelset shaft of which is arranged the third exemplary embodiment of an inventive ballistic protection arrangement.

FIG. 5 shows a chassis of a rail vehicle with a chassis frame 13, a drive motor gearbox unit 14 connected to the chassis frame 13 and a first wheelset 1 with a first wheel 2, a second wheel 3 and a wheelset shaft 4. The first wheelset 1 is coupled via a first wheelset bearing to a first wheelset bearing housing 15 and via a second wheelset bearing to a second wheelset bearing housing 16 on the chassis frame 13. Furthermore, a first primary spring 17 and a second primary spring 18 are arranged between the first wheelset 1 and the chassis frame.

The drive motor gearbox unit 14 is coupled to the first wheelset 1.

Not shown in FIG. 5 is a second wheelset that is configured, with regard to design and its coupling to the chassis frame 13, identically to the first wheelset 1.

Arranged on the wheelset shaft 4 in a region between the drive motor gearbox unit 14 and the first gearbox bearing housing 15 is a ballistic protection arrangement. This arrangement has a shell 5 that encapsulates the wheelset shaft 4. Arranged on the shell 5, as shown also in FIGS. 3 and 4, is a zip fastener 8. The zip fastener is closed and the shell 5 is fixed on the wheelset shaft 4.

Figure 6:
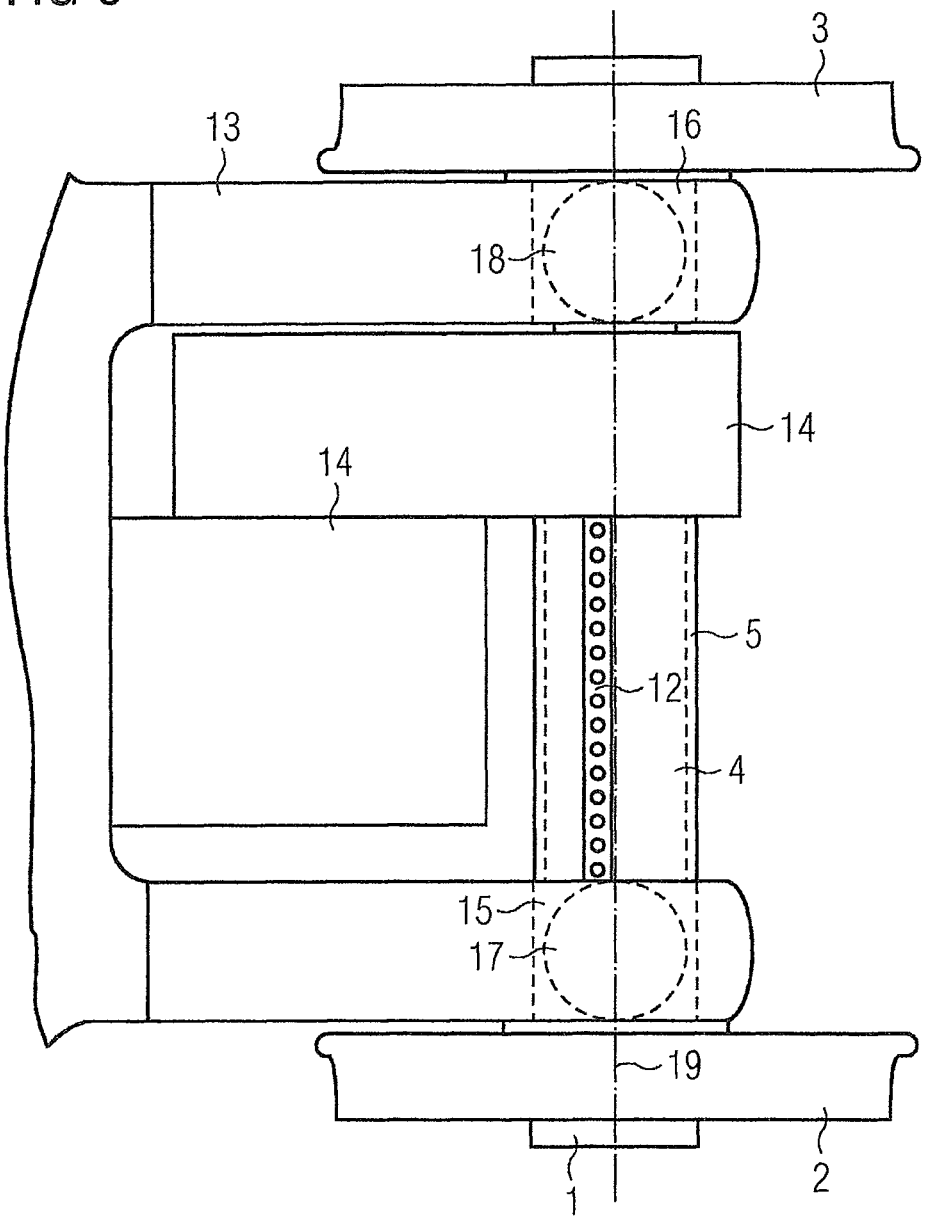
FIG. 6 is a plan view of a portion of a chassis with a first wheelset around the wheelset shaft of which is arranged a fourth exemplary embodiment of an inventive ballistic protection arrangement with a button fastener.

Shown in FIG. 6 is a chassis of a rail vehicle which, with regard to design principles, corresponds to the chassis variant shown in FIG. 5. Therefore, some of the same reference characters are used in FIG. 6 as in FIG. 5.

Arranged on the wheelset shaft 4 in a region between a drive motor gearbox unit 14 and a first wheelset bearing housing 15 is a ballistic protection arrangement. This arrangement has a shell 5 that encapsulates the wheelset shaft 4. A button fastener 12 is arranged on the shell 5.

The button fastener 12 has, on one side of the shell 5, a row of buttons with press buttons and, on the other side of the shell 5, a row with recesses.

In an assembled state shown in FIG. 6, the press buttons are snap-locked into the recesses. The button fastener 12 is therefore closed and the shell 5 is fixed on the wheelset shaft 4.

In accordance with the invention, it is also conceivable to dispense with a closure on the shell 5 and to produce the shell 5, for example, from a stretchable material. With this, following a production process of the wheelset shaft 4, the shell 5 can be pushed over it similarly to a stocking. The shell 5 is placed on the wheelset shaft 4 and is then fixed on the wheelset shaft.

Furthermore, it is also possible to arrange a plurality of shells 5 on the wheelset shaft 4, for example, a first shell between the first wheelset bearing housing 15 and a first shaft brake disk (not shown in FIGS. 1 to 6) and a second shell between the first shaft brake disk and a second shaft brake disk (also not shown), etc.

It is also conceivable that the shell 5 comprises, for example, a first partial shell and a second partial shell, the cross-sections of which have the same radii and that can be connected to one another via a first zip fastener and a second zip fastener.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A ballistic protection arrangement for a vehicle chassis, comprising:

at least one first wheelset which comprises a first wheel, a second wheel and a wheelset shaft; and a shell comprising at least one inner first material layer having a first fiber material which is arrangeable round the wheelset shaft;

wherein the shell comprises an outer second material layer;

wherein the first material layer is pressed together with the second material layer;

wherein the first fiber material of the at least one inner first material layer comprises polyethylene;

wherein the outer second material layer is made of a metallic material; and wherein the ballistic protection arrangement is configured in a pliable manner and, based on the outer second material layer, has a high level of tensile strength.

2. The ballistic protection arrangement as claimed in claim 1, wherein the first fiber material of the at least one inner first material layer is configured as a fiber woven fabric.

3. The ballistic protection arrangement as claimed in claim 1, wherein the outer second material layer is configured as a fiber-reinforced plastic with a second fiber material.

4. The ballistic protection arrangement as claimed in claim 3, wherein the at least one inner first material layer is pressed together with the outer second material layer.

5. The ballistic protection arrangement as claimed in claim 3, wherein the second fiber material comprises glass fibers.

6. The ballistic protection arrangement as claimed in claim 5, wherein the fiber-reinforced plastic comprises a matrix of organic material.

7. The ballistic protection arrangement as claimed in claim 3, wherein the fiber-reinforced plastic comprises a matrix of organic material.

8. The ballistic protection arrangement as claimed in claim 1, wherein the shell comprises at least one zip fastener.

9. The ballistic protection arrangement as claimed in claim 1, wherein the at least one inner first material layer is pressed together with the outer second material layer.

10. The ballistic protection arrangement as claimed in claim 1, wherein the at least one inner first material layer is configured as a fiber-reinforced plastic with the first fiber material and a second fiber material.

11. The ballistic protection arrangement as claimed in claim 10, wherein the second fiber material comprises glass fibers.

12. The ballistic protection arrangement as claimed in claim 10, wherein the fiber-reinforced plastic comprises a matrix of organic material.

13. The ballistic protection arrangement as claimed in claim 1, wherein the shell comprises at least one button fastener.

14. The ballistic protection arrangement as claimed in claim 1, wherein the shell comprises at least one first partial shell and one second partial shell; and wherein a first cross-section of the at least one partial shell and a second cross-section of the second partial shell have identical radii.

15. The ballistic protection arrangement as claimed n claim 1, wherein the shell is configured to be cylindrical.

16. The ballistic protection arrangement as claimed in claim 1, wherein the vehicle comprises a rail vehicle.

* * * * *